United States Patent [19]

Tatsumi et al.

[11] 4,074,517

[45] Feb. 21, 1978

[54] GEAR TRAIN FOR A WRIST WATCH

[75] Inventors: Yoshio Tatsumi; Tooru Kadowaki, both of Tokyo, Japan

[73] Assignee: Kabushiki Kaisha Daini Seikosha, Japan

[21] Appl. No.: 705,006

[22] Filed: July 14, 1976

[30] Foreign Application Priority Data

July 14, 1975 Japan ..... 50-98181

[51] Int. Cl.[2] ..... G04B 13/02

[52] U.S. Cl. ..... 58/140 R; 58/59; 58/138; 58/139

[58] Field of Search ..... 58/140 R, 57, 59, 2, 58/7, 138, 139; 308/36 A, 237 R

[56] References Cited

U.S. PATENT DOCUMENTS

| | | | |
|---|---|---|---|
| 3,138,916 | 6/1964 | Beaumann | 58/59 |
| 3,479,813 | 11/1969 | Kocher | 58/59 |
| 3,492,808 | 2/1970 | Wuthrich | 58/59 |

FOREIGN PATENT DOCUMENTS

| | | | |
|---|---|---|---|
| 177,971 | 6/1935 | Switzerland | 58/59 |

*Primary Examiner*—Ulysses Weldon

*Attorney, Agent, or Firm*—Robert E. Burns; Emmanuel J. Lobato; Bruce L. Adams

[57] ABSTRACT

In the gear train of a wrist watch a jewel mounted on the lower side of a gear wheel connected to the second hand engages the enlarged upper end of the center pipe. The friction factor between the gear wheel and the center pipe is thereby reduced and the performance of the watch is improved.

5 Claims, 4 Drawing Figures

GEAR TRAIN FOR A WRIST WATCH

FIELD OF INVENTION

The present invention relates to the gear train for a wrist watch and particularly to means for reducing friction and improving the performance of the watch.

BACKGROUND OF INVENTION

In wrist watches it is common practice to use jewels as bearings mounted between the base plate and support members for reducing the friction factor and improving the performance of the watch. However in some cases it is impossible to mount jewels between the base plate and support members by reason of lack of space. Where jewels cannot be used the friction factor is increased and the performance of the watch suffers.

SUMMARY OF INVENTION

It is an object of the present invention to overcome the difficulties and disadvantages of prior constructions and to provide at low cost a wrist watch having improved performance characteristics. In accordance with the invention a jewel mounted on the lower side of a gear wheel connected to the second hand of the watch engages the enlarged upper end of the center pipe thereby reducing friction and improving watch performance.

BRIEF DESCRIPTION OF DRAWINGS

The major objects and advantages of the invention will be more fully understood from the following description of preferred embodiments shown by way of example in the drawings in which.

DESCRIPTION OF PREFERRED EMBODIMENTS

Figure 1:
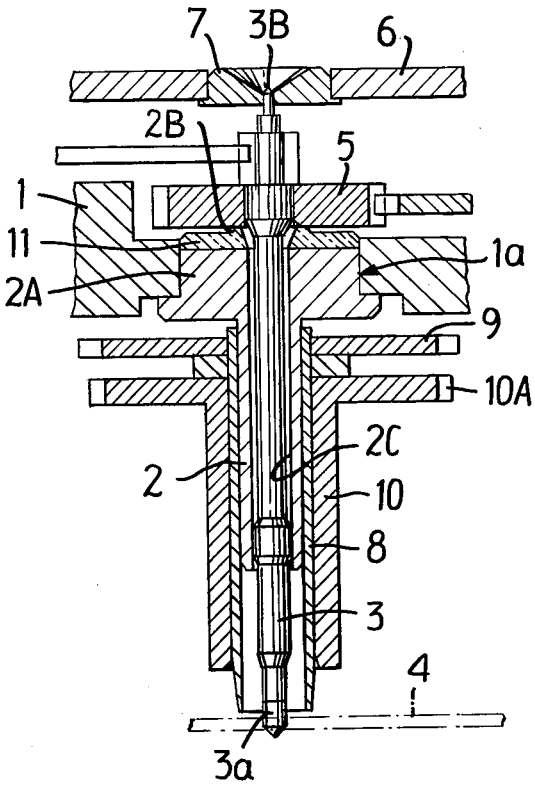
FIG. 1 is a cross sectional view of the gear train of a wrist watch.

In the construction shown in FIG. 1 the center pipe 2 is mounted on the base plate 1 by an enlarged portion 2A of the center pipe which is received in a hole 1a of the base plate. The fourth wheel 3 is rotatably mounted in the central hole 2C of the center pipe 2. The second hand 4 is mounted on the lower end portion 3A of the fourth wheel 3. The fourth gear wheel 5 is mounted on an upper portion of the fourth wheel 3 above the base plate 1. The upper end portion 3B of the fourth wheel 3 is rotatably mounted on the casing 6 by means of a bearing 7. The minute wheel 8 encircles and is coaxial with the center pipe 2. The minute gear wheel 9 is mounted on the upper portion of the minute wheel 8. The hour wheel 10 for 24 hours encircles and is coaxial with the minute wheel 8 and is provided at its upper end with an hour gear wheel 10A.

As illustrated in FIG. 1 the lower portion of the fourth gear wheel 5 rotatably engages the upper surface of an annular protrusion 2B of the enlarged portion 2A of the center pipe 2. As the fourth gear wheel 5 is rotated against contact friction, the rotary energy is reduced and performance of the watch is impaired. In order to reduce such friction a jewel 11 is mounted on the upper side of the enlarged portion 2A of the center pipe 2 and includes the protrusion 2B which is engaged by the fourth gear wheel 5. However it is very difficult precisely to process the jewel according to the clearance of the fourth wheel 3 and furthermore the jewel interferes with the processing of the center pipe 2 and the mounting of the center pipe in the base plate 1.

Figure 2:
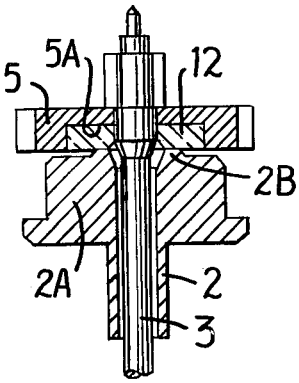
FIG. 2 is a partial cross sectional view of the gear train of the present invention.

In accordance with the present invention as illustrated in FIG. 2 a jewel 12 for reducing the friction factor between the fourth gear wheel 5 and the center pipe 2 is mounted not on the enlarged portion 2A of the center pipe but in a recess 5A on the lower side of the fourth gear wheel 5. The jewel 12 engages an annular protuberance 2B on the enlarged portion 2A of the center pipe 2. With this construction the center pipe 2 can be easily made and mounted and likewise the fourth gear wheel 5 in which the jewel 12 is mounted can be easily manufactured and easily mounted on the fourth wheel 3 so that the cost of producing the watches is reduced.

Figure 3:
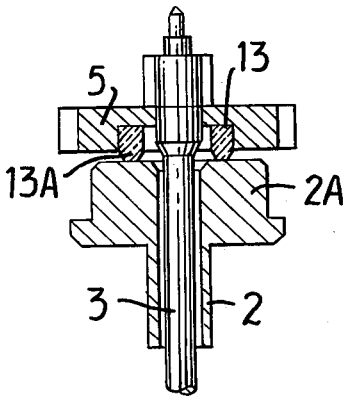
FIGS. 3 and 4 are respectively cross sectional views showing modifications.
Figure 4:
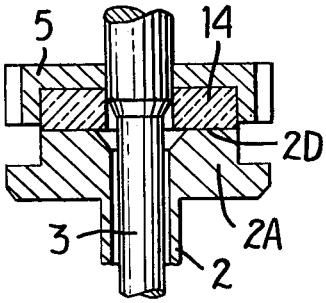

The construction of the jewels according to the present invention is not limited to a flat ring type set flush with the lower face of the fourth gear wheel 5 as illustrated in FIG. 2. Thus for example it is possible to employ a ring-shaped jewel 13 having a tapered projecting portion 13A as shown in FIG. 3. In this case the protuberance 2B is eliminated and the projecting portion 13A of the jewel engages a flat upper face of the enlarged portion 2A of the center pipe 2. Further it is possible to employ a flat ring-shaped jewel 14 having a flat surface engaging a flat upper surface 2D of the enlarged portion 2A in the center pipe as illustrated in FIG. 4. In this construction it is preferable to have the dimension of the flat upper portion 2B of the center pipe smaller than the dimension of the flat lower surface of the jewel 14.

It will thus be seen that according to the present invention a bearing jewel is mounted on the lower side of the gear wheel for the second hand so as to engage the end of the center pipe thus reducing friction and making it possible to obtain a watch of high efficiency. Further the construction in accordance with the invention facilitates manufacture and assembly of the watch parts and thereby reduces the cost of production.

While preferred embodiments of the invention have been shown by way of example of the drawings it will be understood that various modifications can be made and hence the invention is in no way limited to the illustrated embodiments.

What we claim is:

1. A gear train for a wrist watch movement comprising in combination: a center pipe, a gear wheel rotatably mounted coaxially with and at one end of said center pipe, said gear wheel being connected to a hand of the watch, and a jewel recessed in the lower face of said gear wheel and rotatably engaging said end of said center pipe, whereby the friction factor of said gear wheel in a rotary state is reduced.

2. A gear train according to claim 1, in which the fourth wheel of said watch movement extends through said center pipe, said gear wheel being mounted on one end portion of said fourth wheel and said watch hand being mounted at the opposite end thereof.

3. A gear train according to claim 1, in which said jewel has a flat lower face engaging an annular protuberance on an enlarged end portion of said center pipe.

4. A gear train according to claim 1, in which said jewel projects beyond the lower face of said gear wheel and has a flat face engaging a flat face on an enlarged end portion of said center pipe.

5. A gear train according to claim 1, in which said jewel is in the form of a ring having an annular tapered portion projecting below the lower face of said gear wheel and engaging a flat face on an enlarged end portion of said center pipe.

* * * * *